US005779166A

United States Patent [19]

Ruokonen et al.

[11] Patent Number: 5,779,166

[45] Date of Patent: Jul. 14, 1998

[54] ADJUSTABLE CRUSHER

[75] Inventors: Markku Ruokonen, Lempäälä; Raimo Koski, Nokia, both of Finland

[73] Assignee: Norderg-Lokomo Oy, Tampere, Finland

[21] Appl. No.: 682,595

[22] PCT Filed: Jan. 27, 1995

[86] PCT No.: PCT/FI95/00041

§ 371 Date: Jul. 24, 1996

§ 102(e) Date: Jul. 24, 1996

[87] PCT Pub. No.: WO95/20435

PCT Pub. Date: Aug. 3, 1995

[30] Foreign Application Priority Data

Jan. 28, 1994 [FI] Finland ..... 940438

[51] Int. Cl.[6] ..... B02C 2/06

[52] U.S. Cl. ..... 241/213; 241/214

[58] Field of Search ..... 241/207, 216, 241/37

[56] References Cited

U.S. PATENT DOCUMENTS 2,799,456 7/1957 Behr .
4,339,087 7/1982 Pollak .

FOREIGN PATENT DOCUMENTS 676798 12/1963 Canada ..... 241/213

*Primary Examiner*—Mark Rosenbaum
*Attorney, Agent, or Firm*—Burns, Doane, Swecker & Mathis, L.L.P.

[57] ABSTRACT

The application presents an adjustable cone crusher which has a hydraulic cylinder-plunger-combination (15, 4) for adjusting the setting and supporting a main shaft at its bottom end. The combination contains a bypass channel (21), through which the pressure medium escapes from the cylinder when the combination has been extended by a certain distance. In this way the crushing cone is prevented from rising too much upwards.

18 Claims, 5 Drawing Sheets

ADJUSTABLE CRUSHER

FIELD OF ART

The invention relates to hydraulically adjustable cone crushers or gyratory crushers. Specifically, the invention concerns a safety device to prevent the main shaft from being raised too high when adjusting the setting.

PRIOR ART

A cone crusher has a vertical eccentric shaft provided with an oblique interior hole. The hole mounts a main shaft to which a crushing cone is attached. The crushing cone is surrounded laterally by a crusher body. A crushing chamber is formed by an inner crushing blade attached to the crushing cone and by an outer crushing blade attached to the body. When the eccentric shaft is rotated, the main shaft and thus also the crushing cone are made to move oscillatingly, whereby the gap between the crushing blades will vary at each point during the cycle. The smallest gap occurring during a cycle is called the crusher setting.

The crusher setting is often made adjustable with the aid of a hydraulic system, so that the main shaft can be moved in a vertical direction in relation to the body.

The main shaft is often supported on the body at its top end by using a supporting top bearing. A gyratory crusher generally just means this subordinated kind of cone crusher.

As the crushing blades wear down, the main shaft must be raised correspondingly in order to achieve the same setting. With gyratory crushers in particular there is then a risk of driving the crushing cone into the bearing housing of the supporting top bearing and of thus damaging the crusher. To prevent this, such various limit switches and indicators have been used in crushers of the prior art as usually operate electrically. However, a problem with these has been their unreliable operation.

DESCRIPTION OF THE INVENTION

GENERAL DESCRIPTION

An essential feature of the invention is a bypass channel through which a pressure medium escapes from the cylinder for adjusting the setting upon exhaustion of the adjustment margin. In this way the main shaft cannot be driven too high.

DESCRIPTION OF THE DRAWINGS

The appended drawings are an integrated part of the description of the invention.

DETAILED DESCRIPTION

The invention can be applied to all types of cone crushers provided with hydraulic equipment for adjusting the setting. The invention is especially suitable for gyratory crushers equipped with a supporting top bearing and wherein the setting is adjusted by moving the main shaft in relation to the eccentric shaft.

The adjusting plunger is preferably a plunger surrounding the eccentric shaft and with the main shaft pressing against its bottom. In this way a compact structure is obtained, wherein the bypass channel for pressure medium in accordance with the invention can also be conveniently arranged by conducting pressure medium between the cylinder and the plunger into the crusher's lubricating oil circuit.

However, the invention is also suitable for traditional crushers which have a conventional adjusting cylinder and a piston located entirely below the main shaft.

In the solution in accordance with the invention the pressure medium is allowed to flow away from the cylinder to a lower pressure by way of a special bypass channel, when the main shaft reaches its topmost permissible position. The quantity of pressure medium can then no longer be increased in the cylinder and thus the main shaft can not be raised further.

The bypass channel for pressure medium may run between the cylinder and the plunger, through the cylinder or through the plunger. The bypass channel may consist, for example, of one or several grooves, holes or chamfers made in the cylinder wall. The medium may flow from the cylinder into the crusher's lubricant circuit or into the hydraulic adjusting circuit or it may leave the system altogether.

The safety device in accordance with the invention is first of all reliable. Normally it is also inherently such that it cannot be made non-operative even intentionally and thus to try to drive the main shaft all the way to the risk limit.

Certain advantageous applications of the invention are described in the following in greater detail and referring to the appended drawings of the specification.

EXAMPLE 1

Figure 1:
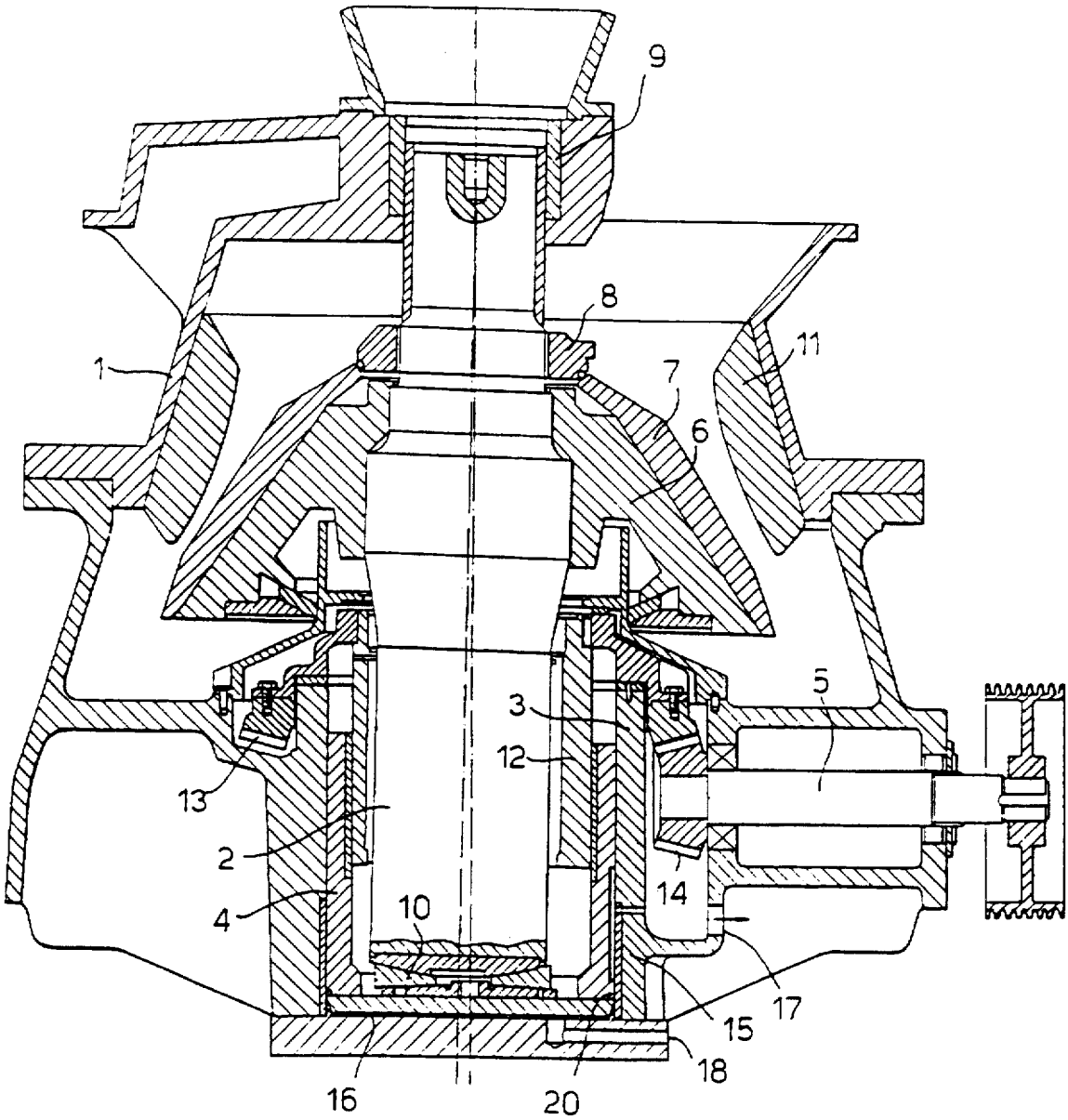
FIG. 1 shows a gyratory crusher in accordance with the invention.

The main components of the crusher in FIG. 1 are a body 1, which contains a main shaft 2, an eccentric shaft 3, an adjusting plunger 4 and a driving shaft 5.

Main shaft 2 mounts a cone 6 mounting a conical inner crushing blade 7. A nut 8 fitted with a thread to the main shaft functions as the means for mounting the inner crushing blade.

The top end of main shaft 2 is journalled in body 1 with the aid of a supporting top bearing 9, which allows the main shaft to perform a swinging pendulous motion and a motion in a vertical direction in relation to the body. The bottom end of the main shaft rests on adjusting plunger 4 through a thrust bearing combination 10 allowing the main shaft end to perform a circular motion.

Body 1 has a detachable top part to which are mounted an outer crushing blade 11 and an inner crushing blade 7 which constitute a crushing chamber. The crushing blades are wearing parts which are exchangeable.

Eccentric shaft 3 has a cylindrical inner hole into which main shaft 2 is fitted with the aid of an oblique eccentric bearing 12. The eccentric shaft mounts around it a secondary gear 13 meshing with a primary gear 14 on driving shaft 5. The rotational motion of the driving shaft is thus turned into a forced rotation of the eccentric shaft and the eccentric bearing around a vertical axis, which for its part brings about an oscillating motion of the main shaft.

Adjusting plunger 4 is a plunger surrounding eccentric shaft 3 and having main shaft 2 pressing against its bottom. The adjusting plunger is sealed into a cylinder 15 in body 1. The cylinder extends above the bottom end of the eccentric shaft so that radial forces of the main shaft can be transferred into the body through the plunger and the cylinder.

Cylinder 15 is combined with a hydraulic circuit. By changing the quantity of pressure medium 16 in the cylinder it is possible to raise and lower plunger 4 and thus also main shaft 2 and in this way to adjust the setting, that is, the gap between crushing blades 7 and 11. As the crushing blades wear, the main shaft must be raised correspondingly upward for keeping up a certain setting.

The bearings and gears of the crusher are lubricated by circulating lubricant through them. The same liquid (oil) functions both as pressure medium 16 and as lubricant, whereby the liquid is pumped from the same container in either circuit. The lubricant is removed from an assembly 17. The pressure medium is brought into cylinder 15 from an assembly 18.

Plunger 4 is sealed into cylinder 15 with the aid of a cylinder bushing 19 and an annular seal 20.

To prevent main shaft 2 from being raised so high that nut 8 would contact the bearing housing of supporting top bearing 9, cylinder bushing 19 and cylinder 15 are provided with a groove 21 (FIG. 2) functioning as a bypass channel. As seal 20 rises to the level of the groove, pressure medium 16 is allowed to flow from cylinder 15 through the groove into the lubricating oil circuit, where there is practically no counterpressure at all. The vertical distance H between the bypass channel and the plunger seal 20 is dimensioned so that it corresponds to a safe raising margin for the main shaft.

In addition, the system may be used for assessing the degree of wear of bearing combination 10 when main shaft 2 is driven to its top position and the distance between nut 8 and supporting top bearing 9 is measured.

EXAMPLE 2

Figure 2:
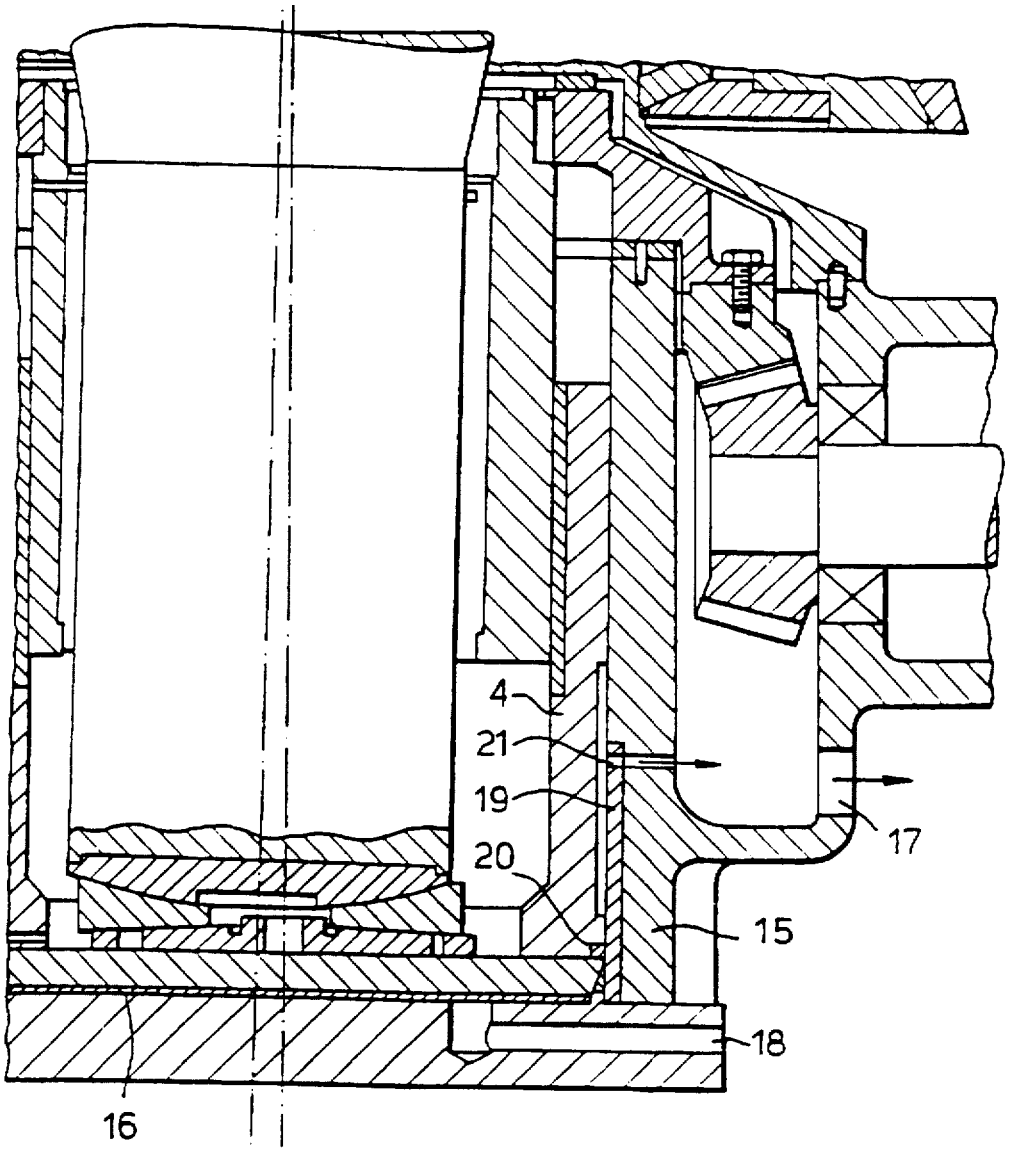
FIG. 2 shows en enlarged detail of the crusher shown in FIG. 1.
Figure 3:
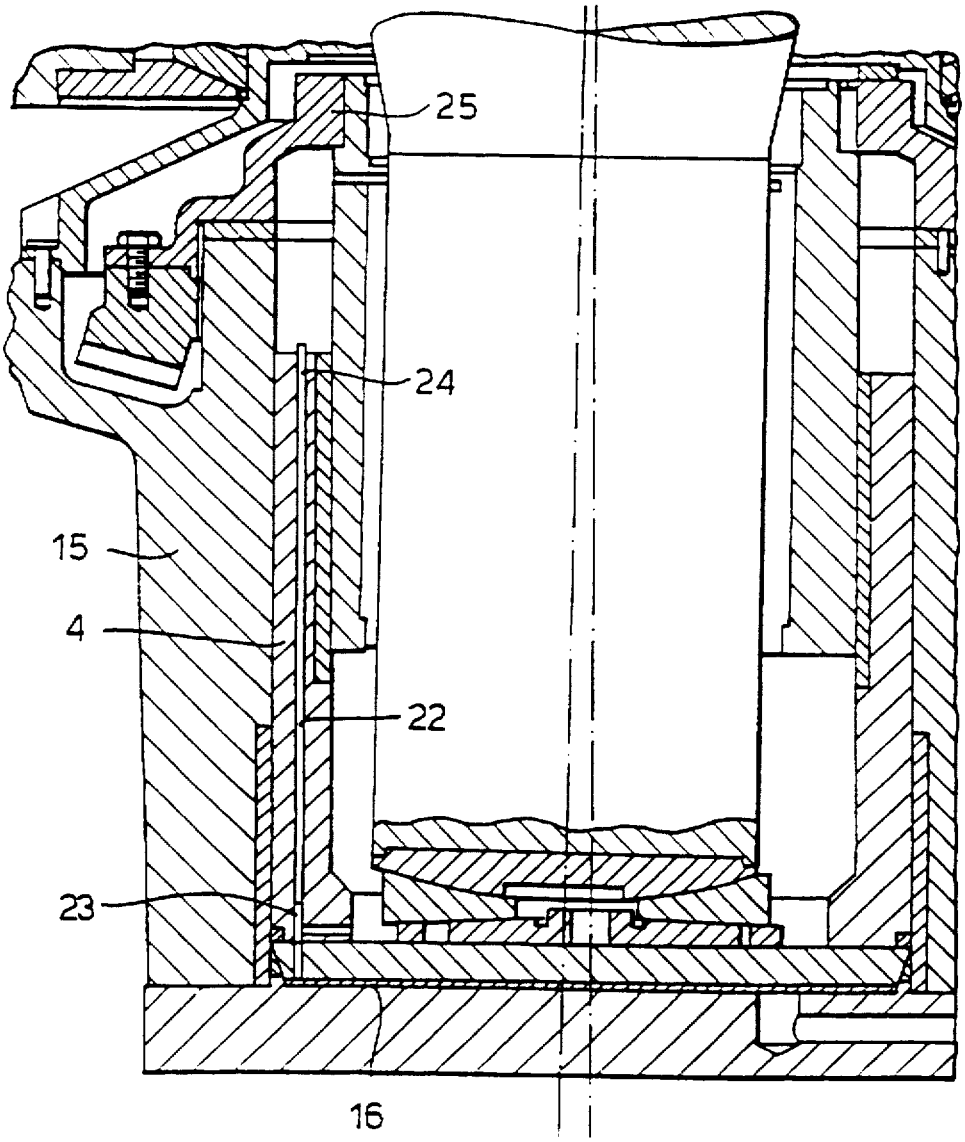
FIG. 3 shows the adjustment cylinder and the lower part of the main shaft in another gyratory crusher in accordance with the invention.

FIG. 3 shows the same type of gyratory crusher as FIGS. 1 and 2 provided with a movable adjusting plunger 4. In the wall of this adjusting plunger there is a hole 22 extending from the top all the way to the cylinder chamber and having a back-pressure valve 23 at its bottom end. In a normal situation the valve will prevent pressure medium 16 from escaping from the cylinder chamber through the hole. The hole also has a rod 24 with a top end extending above the top edge of the plunger and with its bottom end against a closing means in the valve. When the plunger rises so high that the top end of the rod contacts the lower surface of an annular flange 25 at the top end of eccentric shaft, the bottom end of the rod will press the closing means of the valve downwards, so that the valve will open and the pressure medium will thus be free to escape through the hole. In this way, the adjusting plunger and the main shaft can not be raised further upwards. When the adjusting plunger is lowered, the valve will close and will again operate normally. The rod is dimensioned so that the valve will open just before the crushing cone contacts the bearing housing of the supporting top bearing as the main shaft is being raised.

EXAMPLE 3

Figure 4:
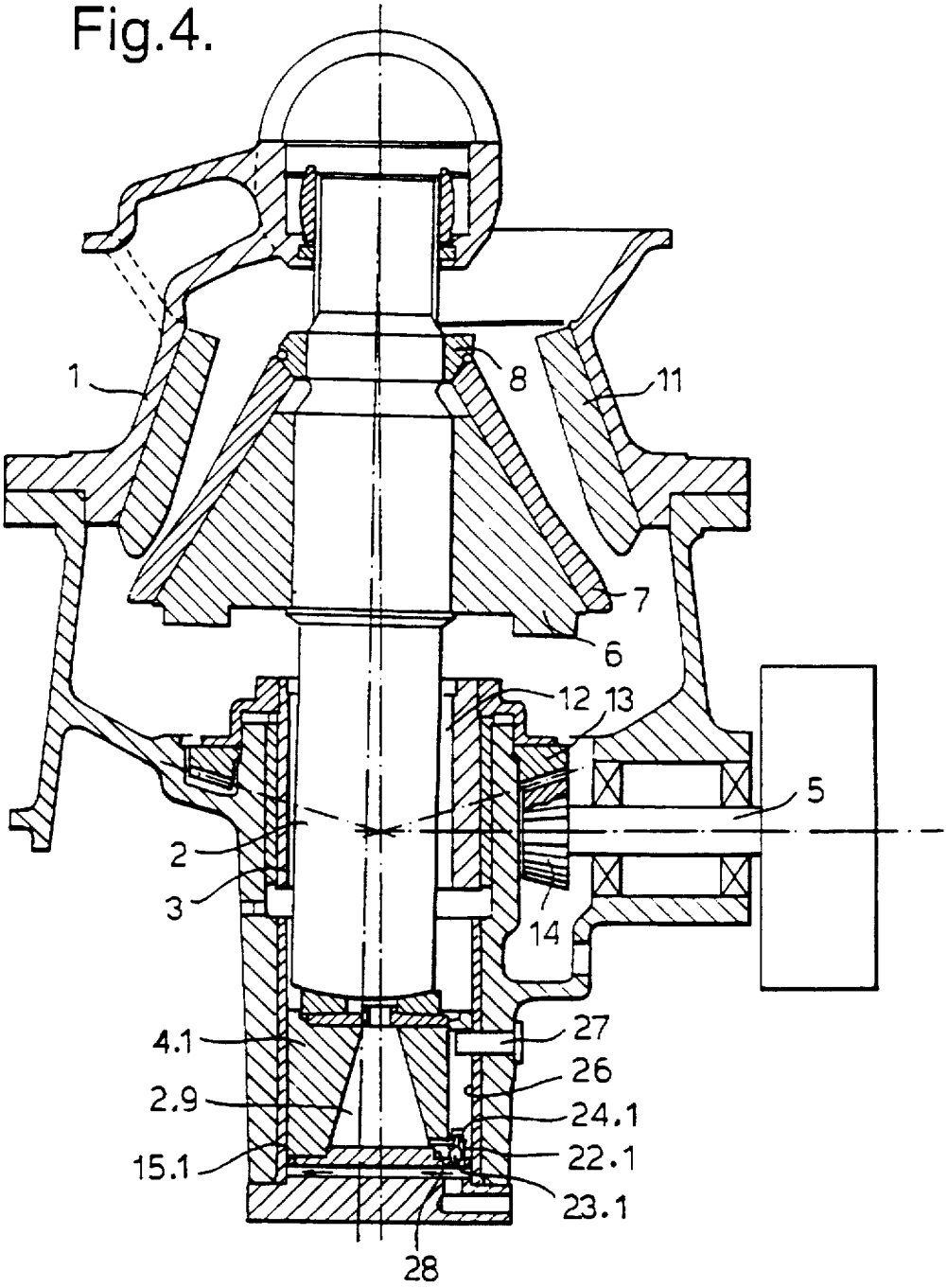
FIG. 4 shows the adjustment cylinder and the main shaft in a third gyratory crusher in accordance with the invention.
Figure 5:
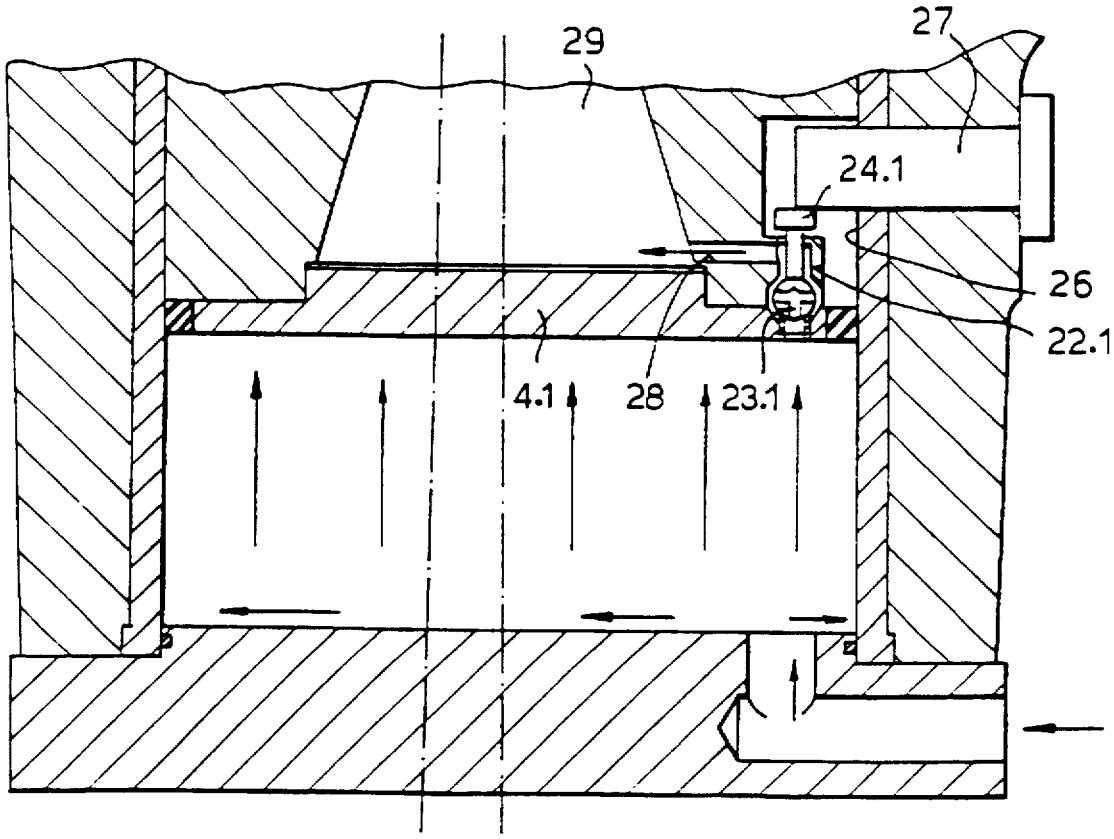
FIG. 5 shows a detail of the crusher shown in FIG. 4.

FIGS. 4 and 5 show such a traditional adjustment solution, wherein the cylinder 15.1 has a movable adjusting piston 4.1 located entirely below the main shaft 2 and the eccentric shaft 3. In crushers of this type there is usually a vertical groove 26 in one side of the adjusting piston to receive a limiting pin 27 extending through the cylinder wall. The pin prevents the piston from rotating, but permits its vertical motion.

In the solution in accordance with the invention a hole 22.1 is made from the bottom of groove 26 into the cylinder chamber with a valve 23.1 located on its bottom. The hole contains a guiding pin 24.1 for the closing means of the valve with its top end extending above the hole. In addition, a bypass channel 28 extends from the hole into a lubricant chamber 29 in piston 4.1. When the piston is raised so high that the guiding pin strikes against limit pin 27 for the rotational motion, the guiding pin will open the closing means of the piston and pressure medium will flow from the cylinder by way of the bypass channel into the lubricant circuit in the piston.

We claim:

1. An adjustable cone crusher, comprising:

a body;

an eccentric shaft positioned in the body and rotatable about a vertical axis, the eccentric shaft having a vertically oriented oblique hole;

a main shaft journalled in the hole of the eccentric shaft, the main shaft having a bottom end and a top end;

a hydraulic cylinder-plunger-combination, the hydraulic cylinder being adapted to receive a pressure medium to vertically extend the hydraulic cylinder-plunger-combination, the bottom end of the main shaft being supported on the hydraulic cylinder-plunger-combination so that extension of the hydraulic cylinder-plunger-combination causes upward movement of the main shaft, the hydraulic cylinder-plunger-combination including a bypass channel which is opened and closed depending upon the position of the plunger, said bypass channel being covered by the plunger so as to be closed when the plunger is located below a predetermined raised position and being open when the plunger is at the predetermined raised position to permit pressure medium in the cylinder to escape.

2. The adjustable cone crusher as defined in claim 1, wherein the top end of the main shaft is supported on the body by a supporting top bearing.

3. The adjustable cone crusher as defined in claim 1, wherein the plunger of the hydraulic cylinder-plunger-combination supports the main shaft.

4. The adjustable cone crusher as defined in claim 3, wherein the plunger surrounds the eccentric shaft and includes a bottom supporting the main shaft.

5. The adjustable cone crusher as defined in claim 1, wherein the bypass channel leads from the cylinder through a lubricant circuit and is adapted to be connected to a hydraulic circuit.

6. The adjustable cone crusher as defined in claim 1, wherein a portion of the bypass channel is located between the hydraulic cylinder and the plunger.

7. The adjustable cone crusher as defined in claim 1, wherein the bypass channel is located in the cylinder.

8. An adjustable cone crusher, comprising:

a body;

an eccentric shaft positioned in the body and rotatable about a vertical axis, the eccentric shaft having a vertically oriented oblique hole;

a main shaft journalled in the hole of the eccentric shaft, the main shaft having a bottom end and a top end;

a hydraulic cylinder-plunger-combination, the hydraulic cylinder being adapted to receive a pressure medium to vertically extend the hydraulic cylinder-plunger-combination, the bottom end of the main shaft being supported on the hydraulic cylinder-plunger-combination so that extension of the hydraulic cylinder-plunger-combination causes upward movement of the main shaft, the hydraulic cylinder-plunger-combination being provided with a bypass channel and a valve positioned in the bypass channel;

an opening member adapted to open the valve, the opening member being operatively associated with the plunger for moving with the plunger as the plunger moves between a predetermined raised position and positions below the predetermined raised position, the opening member engaging a counter surface when the plunger is in the predetermined raised position to thereby open the valve to permit pressure medium in the cylinder to escape.

9. The adjustable cone crusher as defined in claim 8, wherein the top end of the main shaft is supported on the body by a supporting top bearing.

10. The adjustable cone crusher as defined in claim 8, wherein the plunger of the cylinder-plunger-combination supports the main shaft.

11. The adjustable cone crusher as defined in claim 8, wherein the plunger surrounds the eccentric shaft and includes a bottom supporting the main shaft.

12. The adjustable cone crusher as defined in claim 8, wherein the bypass channel is in the plunger.

13. The adjustable cone crusher as defined in claim 8, wherein the opening member is an elongated rod.

14. The adjustable cone crusher as defined in claim 8, wherein the opening member is a guiding pin.

15. The combination of a safety device and an adjustable cone crusher, the cone crusher including a hydraulic cylinder-plunger-combination which supports a main shaft and a pressure medium space in the hydraulic cylinder for receiving a pressure medium to raise the main shaft vertically upwards through upward vertical movement of the plunger, the safety device including a bypass channel in the hydraulic cylinder-plunger-combination which alternatively communicates with the pressure medium space and is prevented from communicating with the pressure medium space based on the position of the plunger, with the bypass channel being prevented from communicating with the pressure medium space when the plunger is positioned below a predetermined raised position and being in communication with the pressure medium space when the plunger is in the predetermined raised position to permit pressure medium in the pressure medium space to escape out of the pressure medium space.

16. The combination of claim 15, wherein the bypass channel is located in the cylinder.

17. The combination of claim 15, wherein the top end of the main shaft is supported in a supporting top bearing.

18. The combination of claim 15, wherein the bypass channel is located in the plunger.

* * * * *